US005681247A

United States Patent [19]

Webber

[11] Patent Number: 5,681,247

[45] Date of Patent: *Oct. 28, 1997

[54] CONSTANT TENSION EXERCISE DEVICE

[76] Inventor: Randall T. Webber, 11162 Morning Creek Dr., San Diego, Calif. 92128

[ * ] Notice: The term of this patent shall not extend beyond the expiration date of Pat. No. 5,236,406.

[21] Appl. No.: 410,979

[22] Filed: Mar. 27, 1995

Related U.S. Application Data

[63] Continuation of Ser. No. 95,303, Jul. 21, 1993, Pat. No. 5,401,227, which is a continuation of Ser. No. 658,100, Feb. 20, 1991, Pat. No. 5,236,406.

[51] Int. Cl.[6] ..... A63B 21/06

[52] U.S. Cl. ..... 482/100; 482/137; 482/138

[58] Field of Search ..... 482/94, 97–103, 482/133, 135–138

[56] References Cited

U.S. PATENT DOCUMENTS

| | | | |
|---|---|---|---|
| 4,627,616 | 12/1986 | Kauffman . | |
| 4,792,135 | 12/1988 | Chin-Sen | 482/138 |
| 4,844,456 | 7/1989 | Habing et al. | 482/100 |
| 4,854,578 | 8/1989 | Fulks | 482/100 |
| 4,898,381 | 2/1990 | Gordon . | |
| 4,915,377 | 4/1990 | Malnke et al. . | |
| 4,982,955 | 1/1991 | Heasley | 482/100 |
| 5,263,915 | 11/1993 | Habing | 482/100 |

*Primary Examiner*—Joe Cheng
*Assistant Examiner*—John Mulcahy
*Attorney, Agent, or Firm*—Brown, Martin, Haller & McClain

[57] ABSTRACT

An exercise device has a support frame and a lever arm attached to the support frame and pivotably movable between a rest position, wherein the lever arm hangs downwardly relative to the support frame, and an extended position, wherein the lever arm is pivoted upwardly from its rest position. A range of motion (ROM) block is rigidly attached to the lever arm, and pivots with the lever arm. The orientation of the ROM block relative to the lever arm can be selectively varied.

A tackle is attached to the ROM block to provide an opposing force to motion of the lever arm from the rest position to the extended position. This tackle includes two pulleys that are attached to the ROM block. The tackle also includes a substantially taut cable that extends between the pulleys, and the cable is connected to a mass. The position of the pulleys relative to the lever arm is established such that the magnitude of the force required to move the lever arm toward the extended position is approximately equal to the magnitude of the weight of the mass.

19 Claims, 5 Drawing Sheets

CONSTANT TENSION EXERCISE DEVICE

This is a continuation of application Ser. No. 08/095,303, filed Jul. 21, 1993 now U.S. Pat. No. 5,401,227, which was a Continuation of application Ser. No. 08/658,100, filed Feb. 20, 1991, now U.S. Pat. No. 5,236,406.

FIELD OF THE INVENTION

The present invention relates generally to exercise devices. More particularly, the present invention relates to devices which can be used to exercise a particular muscle group of a person without requiring the use of free weights. The present invention particularly, though not exclusively, relates to weight machines.

BACKGROUND

Regular exercise, such as weight lifting, is widely known to increase a person's resistance to certain diseases, e.g., cardiovascular disease, and to generally improve a person's fitness, appearance, and overall physical and mental health. Accordingly, a regular exercise regimen that includes weight lifting is beneficial to many people.

Unfortunately, weight lifting requires the lifting and manipulation of relatively cumbersome and unwieldy free weights, leaving a novice or untrained lifter subject to injury. Not surprisingly, a number of devices have been introduced that make use of weights to improve the muscle tone and cardiovascular fitness, yet which avoid the risk of injury inherent with free weights. Such devices, familiarly referred to as "weight machines", typically include a manipulable mass that is lifted by the user through various mechanisms, such as levers and cable pulley systems. Regardless of the system used, weight machines typically restrict the motion of the mass to a single, vertical direction so that the mass cannot develop hard-to-control inertial motion in a lateral direction as it is being vertically lifted, which is the bane of free weights. Consequently, exercising with weight machines is comparatively safer than exercising with free weights.

Furthermore, the ability to isolate the force vector to a single direction permits weight machines to be designed to help the user focus on developing a preselected muscle—more so than may be possible through the use of free weights. More particularly, through the careful arrangement of levers, cables and pulleys, weight machines can be designed to force the user to exercise a particular muscle group, to the exclusion of other muscle groups. This focusing prevents the user from unintentionally "cheating" by using additional muscle groups to assist in lifting the mass.

To optimize the weight training benefit provided by a weight machine, it is desirable that the moving parts of the machine move smoothly while requiring the application of a substantially constant force to move the mass through its entire range of motion. It is also desirable that the machine be adjustable to accommodate the physiques of different users, both in terms of body strength and size. Moreover, it is desirable that the user of the machine be required to move the movable mass that is indicated on the machine throughout the entire range of motion of the mass, in order to provide a relatively accurate measure of the user's level of work/effort. The present invention recognizes that a weight machine can be provided that is adjustable to suit the requirements of different users and that requires a substantially constant force to move the mass through its entire range of motion.

Accordingly, it is an object of the present invention to provide an exercise device that is adjustable to suit more than one user. Another object of the present invention is to provide an exercise device that requires a substantially constant force to move the device through its range of motion. Further, it is an object of the present invention to provide an exercise device that has moving parts capable of being smoothly moved through their entire range of motion. Finally, it is an object of the present invention to provide an exercise device that is easy to use and cost-effective to manufacture.

SUMMARY

An exercise device has a support frame and a range-of-motion (ROM) block pivotably attached to the top of the support frame. More particularly, one end of the ROM block is attached to a pivot shaft. The pivot shaft is in turn attached to the support frame, and the ROM block hangs downwardly from the top of the support frame and can pivot about the pivot shaft.

A lever arm is also pivotally attached to the pivot shaft, and is rigidly connected to the ROM block by a dowel. Specifically, the dowel is attached to the lever arm and is selectively insertable into any one of a number of holes that are formed on the ROM block. Accordingly, the orientation of the lever arm relative to the ROM block can be established as desired by inserting the dowel into the appropriate hole on the ROM block.

Additionally, the lever arm has a handle that is positioned on the lever arm at a preselected distance from the pivot shaft. As envisioned by the present invention, the lever arm is pivotably movable from a rest, i.e., low energy, position wherein the lever arm with ROM block hangs substantially vertically downwardly from the top of the support frame, to an extended, i.e., high energy, position wherein the lever arm with ROM block is pivoted from the rest position. A surface for supporting a person is attached to the support frame such that the person can grasp the handle of the lever arm and move the lever arm toward the extended position. Accordingly, the skilled artisan will appreciate that where the support surface is a seat, a person can sit in the seat and move the lever arm from the rest position to the extended position to simulate a bench press exercise.

A tackle is connected to the lever arm to transfer a force to the lever arm that opposes movement of the arm toward the extended position. More specifically, the tackle includes at least two pulleys that are attached in tandem to the ROM block. At least one of the pulleys is positioned on the ROM block a predetermined distance from the pivot pin.

The tackle also includes a fixed block that is attached to the support frame, and at least two sheaves are attached in tandem to the fixed block. Furthermore, the tackle includes a cable that is guided partially around the periphery of each of the pulleys and sheaves. A first end of the cable is effectively attached to the support frame, and the second end of the cable is connected to a movable mass. As so arranged, the cable is maintained substantially taut throughout the entire range of motion of the lever arm.

In accordance with the present invention, the block-and-tackle is configured to transfer the magnitude of the weight of the mass, through the cable, to oppose movement of the lever arm toward the extended position. Importantly, the preselected distance of the lever arm handle from the pivot shaft and the predetermined distance from the ROM block pulleys to the pivot shaft are established such that the magnitude of the force required to move the lever arm toward the extended position is approximately equal to the magnitude of the weight of the mass.

The present invention further envisions that the first end of the cable can be attached to an elongated pull-down bar intermediate the ends of the bar, for providing a means for exercising the back muscles. Also, a leg extension apparatus can be included on the device for exercising selected leg muscles. More specifically, the leg extension apparatus includes a lower roller that is attached to a pivot arm, and the pivot arm is in turn pivotably attached to the support frame and connected via a cable to the mass for opposing upward pivotable motion of the pivot arm. To support the user's upper leg, an upper roller is positioned on the support frame above the lower roller, and has an elevation relative to the support frame that is approximately as high as the seat. The elevation of the upper roller, however, can be adjusted as appropriate to suit the particular user of the device.

Further details of the present invention are more fully disclosed below in reference to the drawings, in which like numbers correspond to like parts, and in which.

DETAILED DESCRIPTION OF THE PREFERRED EMBODIMENT

Figure 1:
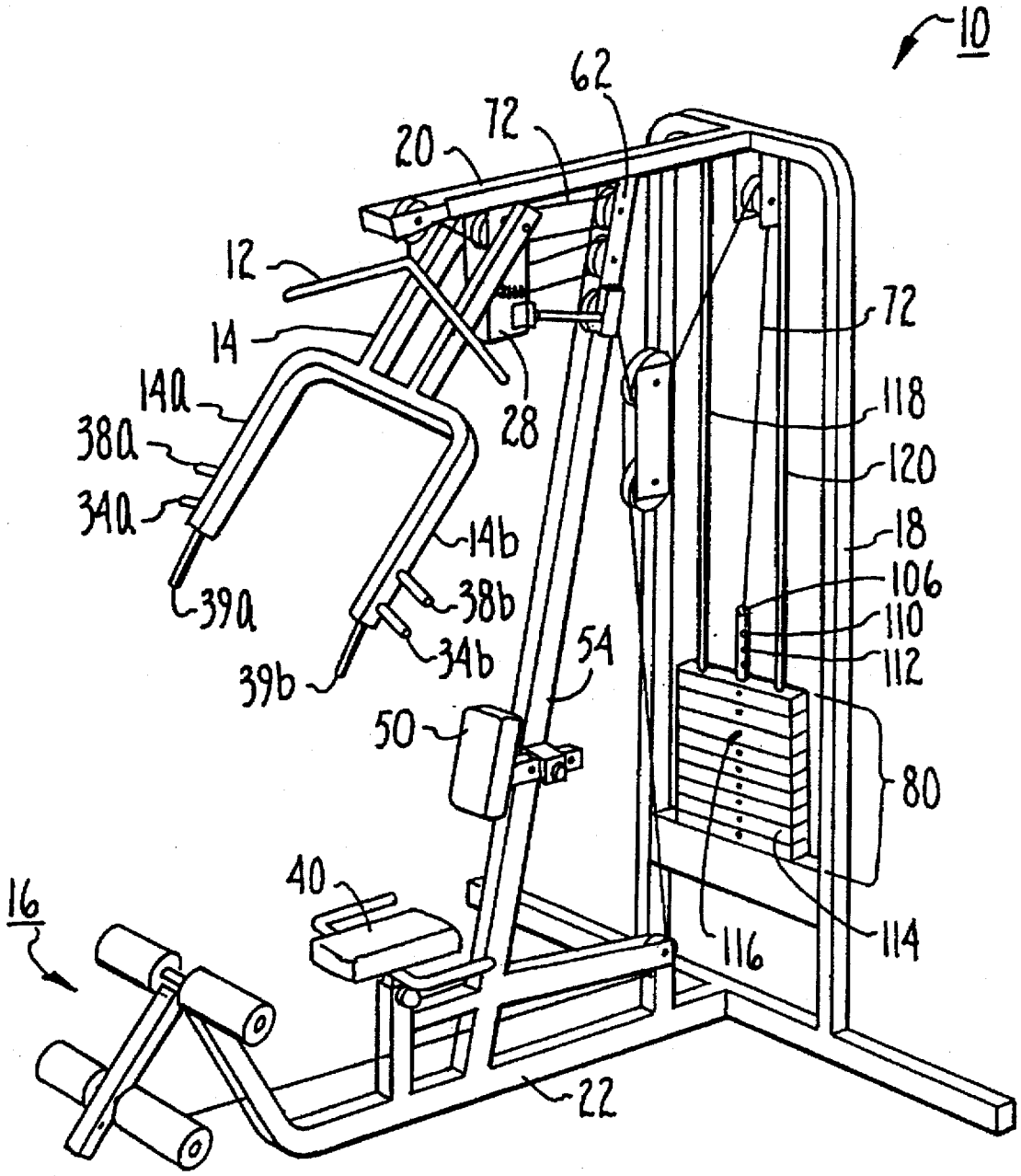
FIG. 1 is a perspective view of the exercise device of the present invention, shown in its intended environment.

Referring initially to FIG. 1, an exercise machine 10 includes an elongated pull-down bar 12 and a lever arm 14, which functions as a chest press bar. As shown, the lever arm 14 is preferably formed with a pair of parallel gripping bars 14*a*, 14*b*. Additionally, the exercise machine 10 is preferably provided with a leg extension apparatus 16.

Figure 2A:
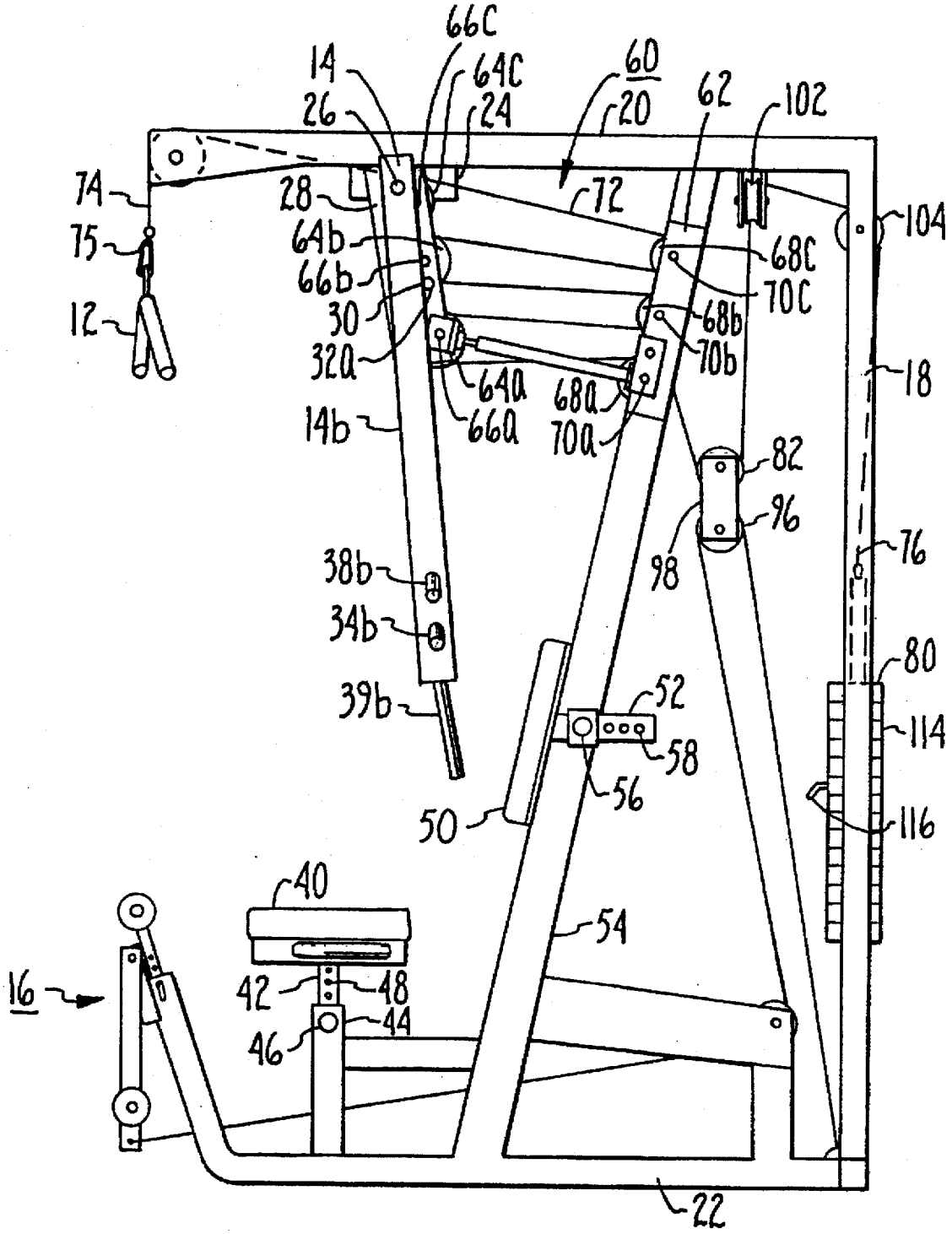
FIG. 2A is a side elevation view of the exercise device of the present invention, showing the lever arm in a rest position and showing a first orientation of the ROM block relative to the lever arm.

Now referring to FIG. 2A, the exercise machine 10 is shown to have a support frame 18 that has a top strut 20 and a bottom strut 22. A support flange 24 is fixedly attached to the top strut 20, and a pivot aperture 25 is formed through the support flange 24. As shown in FIG. 2A, a pivot shaft 26 is mounted in the pivot aperture 25. In accordance with the present invention, the lever arm 14 is rotatably attached to the pivot shaft 26, permitting pivotable motion of the lever arm 14 relative to the top strut 20 between a rest position of the lever arm 14 shown in FIG. 2A and an extended position of the lever arm 14 shown in FIG. 2C. Additionally, FIG. 2A shows that a range of motion (ROM) block 28 is rotatably attached to the pivot shaft 26 for pivotable motion of the ROM block 28 relative to the top shaft 20 of the support frame 18.

Figure 2B:
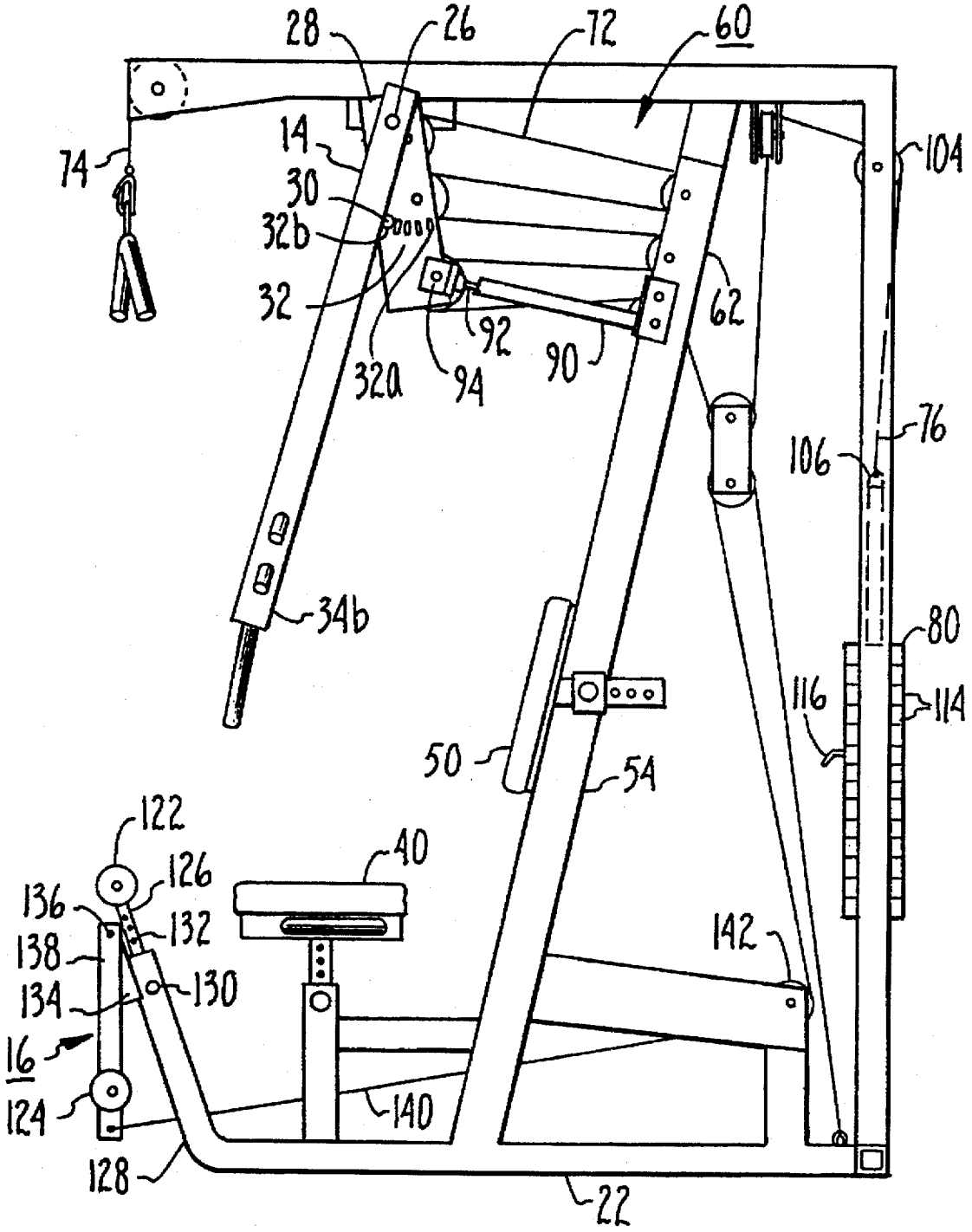
FIG. 2B is a side elevation view of the exercise device of the present invention, substantially similar to FIG. 2A, showing the lever arm in the rest position and showing a second orientation of the ROM block relative to the lever arm.

Importantly, as shown in cross-reference to FIGS. 2A and 2B, a dowel 30 is attached to the lever arm 14 and is insertable into one of a plurality of receiving holes 32 that are formed in the ROM block 28 to pivotally attached the ROM block 28 to the lever arm 14. It is to be appreciated in reference to FIGS. 2A and 2B that the orientation of the ROM block 28 relative to the lever arm 14 can be established by inserting the dowel 30 into a select one of the plurality of holes 32. For example, the dowel 30 can be inserted into a receiving hole 32*a* in order to establish the orientation of the lever arm 14 relative to the ROM block 28 shown in FIG. 2A. On the other hand, the dowel 30 can be extracted from the receiving hole 32*a*, the orientation of the lever arm 14 relative to the ROM block 28 adjusted as desired, and the dowel 30 inserted into a second receiving hole 32*b*, to establish a different orientation of the lever arm 14 relative to the ROM block 28, as shown in FIG. 2B. Thus, while the rest position of the ROM block 28 does not change relative to the top strut 20 or the support frame 18, the orientation of the lever arm 14 relative to the support frame 18 that corresponds to the rest position of the ROM block 28 can be selectively established.

Figure 2C:
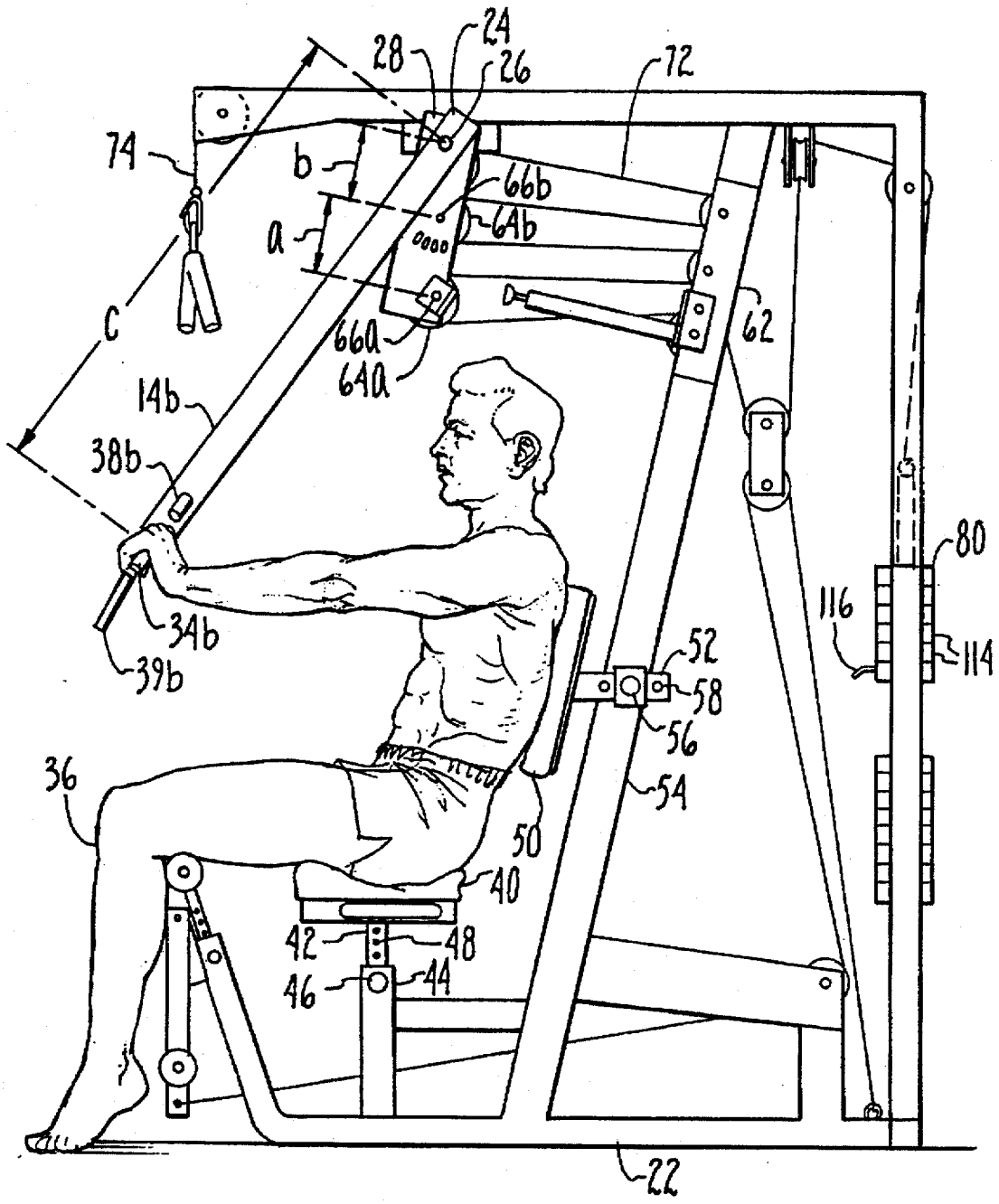
FIG. 2C is a side elevation view of the exercise device of the present invention, substantially similar to FIG. 2B, showing the lever arm in the extended position.

In cross-reference to FIGS. 1, 2A, and 2C, a gripping handle 34*a* is shown attached to or formed integrally with the gripping bar 14*a* and a gripping handle 34*b* is similarly attached to the gripping bar 14*b*, permitting a person 36 (shown in FIG. 2C) to grip the handles 34*a* and 34*b* and move the lever arm 14 toward an extended position. If desired, a second handle pair 38*a,b* and a third handle pair 39*a,b* can be formed on the gripping bars 14*a,b* to permit the person 36 to vary the location of his grip on the lever arm 14.

As best shown in FIG. 2A, a padded seat 40 is movably mounted on the support frame 18. More particularly, the seat 40 has a seat post 42 that is slidably engaged with a hollow riser 44 of the support frame 18. A seat dowel 46 is insertable through a hole (not shown) that is formed in the hollow riser 44, and the dowel 46 can also be inserted as appropriate into one of a plurality of riser holes 48 that are formed in the seat post 42 to establish the desired height of the seat 40 relative to the bottom strut 22. Also, a padded back support 50 having an extending post 52 with a plurality of post holes 55 is slidably engaged with a main riser 54 of the support frame 18. The position of the back support 50 relative to the main riser 54 can be established as desired by appropriately engaging a back support dowel 56 with one of the post of holes 55 formed in the extending post 52. It will be appreciated by the skilled artisan that the person 36 can sit in the seat 40, grasp the gripping handles 34 about chest-high, and urge the lever arm 14 toward the extended position, shown in FIG. 2C, to simulate a free weight bench press exercise.

Still referring to FIG. 2A, the ROM block 28 is shown operatively engaged with a tackle 60. As shown, the tackle 60 connects the ROM block 28 to a fixed block 62, which is mounted on the main riser 54. The tackle 60 includes three disc-shaped pulleys 64*a*, 64*b*, 64*c*, which are preferably rotatably mounted in tandem on the ROM block 28. Alternatively, however, the disc-shaped pulleys 64*a*, 64*b*, and 64*c* could be mounted side-by-side on the ROM block 28, i.e., the disc-shaped pulleys 64*a*, 64*b*, 64*c* can be mounted on the ROM block 28 coaxially with one another. In the embodiment shown in FIG. 2A, each of the disc-shaped pulleys 64*a*, 64*b*, 64*c* has a respective pulley axis shaft 66*a*, 66*b*, 66*c*, each of which is attached to the ROM block 28. As envisioned by the present invention, the disc-shaped pulleys 64 are rotatable about their respective pulley axis shafts 66.

As shown in FIG. 2A, the tackle 60 also includes three disc-shaped sheaves 68*a*, 68*b*, and 68*c*, which are rotatably mounted on the fixed block 62. More particularly, the three sheaves 68*a*, 68*b*, 68*c* are rotatably mounted on respective sheave axis shafts 70*a*, 70*b*, and 70*c* that are attached to fixed block 62. Additionally, the tackle 60 includes a cable 72, such as a conventional ⅛ inch diameter or 3/16 inch diameter nylon coated steel cable, that is guided partially around the peripheries of each of the three pulleys 64a, 64b, 64c and the three sheaves 68a, 68b, 68c. Specifically, the tackle cable 72 has a first cable end 74 that is attached to a connecting ring 75 of the pull-down bar 12, and a second cable end 76 that is attached to a movable mass 80 (best shown in FIG. 1). The cable 72 extends from the first cable end 74, serially around each of the three pulleys 64a–c and the three sheaves 68a–c, to the second cable end 76.

More specifically, in accordance with the cable pathway shown in FIG. 2A, the tackle cable 72 extends serially from the periphery of the first of the three pulleys 64c, to the periphery of the first of the three sheaves 68c, to the periphery of the second of the three pulleys 64b, and to the periphery of the second of the three sheaves 68b. From the second of the sheaves 68b, the cable 72 extends partially around the periphery of the third of the three pulleys 64a, to the periphery of the third of the three sheaves 68a, and to the periphery of a first guide pulley 82.

It is to be understood that in the event pull-down bar 12 is omitted, the first pulley 64c and the first sheave 68c can also be omitted, in which case the first cable end 74 of the cable 72 would be attached to ROM block 28 or main riser 54. Furthermore, second pulley 64b can be omitted when pull-down bar 12 is omitted, and ROM block 28 lengthened as appropriate for establishing the predetermined distance between pulley 64b and pivot shaft 26, as more fully disclosed below.

As shown best in FIG. 2C for the preferred embodiment, the second and the third pulleys 64b, 64a are positioned on the ROM block 28 such that the respective axis shafts 66b, 66a are spaced apart a distance "a". Furthermore, the second pulley 64b is positioned on the ROM block 28 such that the axis shaft 66b is spaced a predetermined distance "b" from the pivot shaft 26. Also, the gripping handles 34a, 34b (only one handle is shown in FIG. 2C) are positioned on the lever arm 14 a preselected distance "c" from the pivot shaft 26. In accordance with the present invention, the distances a, b, and c are established such that a force of substantially equal magnitude to the magnitude of the weight of the movable mass 80 is conveyed to the handle 34. Moreover, substantially all of this force tends to oppose movement of the lever arm 14 toward its extended position. In other words, the substantially the entire magnitude of the weight of the movable mass 80 is transferred through the tackle 60 and the lever arm 14 to the gripping handles 34a, 34b to oppose movement of the lever arm 14 toward the extended position, permitting the person 36 to directly set the work level in accordance with the weight of the movable mass 80.

Referring momentarily to FIG. 2B, an elongated rest stop 90 having a resilient tip 92 is shown attached to the main riser 54. Resilient tip 92 of the rest stop 90 can contact a rest pad 94 that is mounted on the ROM block 28 to limit motion of the ROM block 28 and thereby establish the rest position of ROM block 28 with respect to the support frame 18. As shown, the rest stop 90 is positioned to establish a rest position of the ROM block 28 such that the tackle cable 72 is perpetually taut throughout the range of motion of the lever arm 14, for all orientations of the lever arm 14 relative to the ROM block 28.

To facilitate the relatively smooth motion of the tackle cable 72 during operation of the exercise machine 10, various guide pulleys are appropriately positioned to contact and guide the tackle cable 72 between the third sheave 68a and the second cable end 76. Specifically, in reference to FIG. 2A, the first guide pulley 82 and a second guide pulley 96 are rotatably mounted on a guide pulley block 98, which is not attached to any other of the structure of frame 18. As shown, the tackle cable 72 passes partially around the periphery of the first guide pulley 82 as well as partially around the periphery of a third and a fourth guide pulley 102, 104, both of which are rotatably mounted on the support frame 18. Finally, the second cable end 76 (shown in phantom) of the tackle cable 72 is connected to a connector fitting 106 (also shown in phantom in FIG. 2A) which is attached to a weight transfer rod 110.

As shown in FIG. 1, the transfer rod 110 has formed therein a plurality of apertures 112 that extend transversely through the transfer rod 110. Further, to establish the movable mass 80, a plurality of metal bricks 114 are selectively engaged with the transfer rod 110. More specifically, the transfer rod 110 extends through central passageways (not shown) formed in the center of each brick 114. To establish the number of the metal bricks 114 that are to be included in the movable mass 80 lifted by the person 36, a brick retention peg 116 can be selectively inserted into any one of a plurality of retention apertures 117. As shown, a retention aperture 117 is formed in each of the metal bricks 114, and the retention peg 116 is received simultaneously by the selected retention aperture 117 and the rod aperture 112. Thus, because the metal bricks 114 are vertically stacked, a predetermined number of metal bricks 114 can be held onto the weight transfer rod 110 by placing the brick retention peg 116 in the retention aperture 117 of the brick that, when combined with those lying above, provide an aggregate weight that corresponds to the desired weight. Also, each metal brick 114 is slidably engaged with a pair of anti-sway bars 118, which are connected to the support frame 18 to guide the metal bricks 114 up and down with respect to the support frame 18 when the lever arm 14 is moved.

Figure 3:
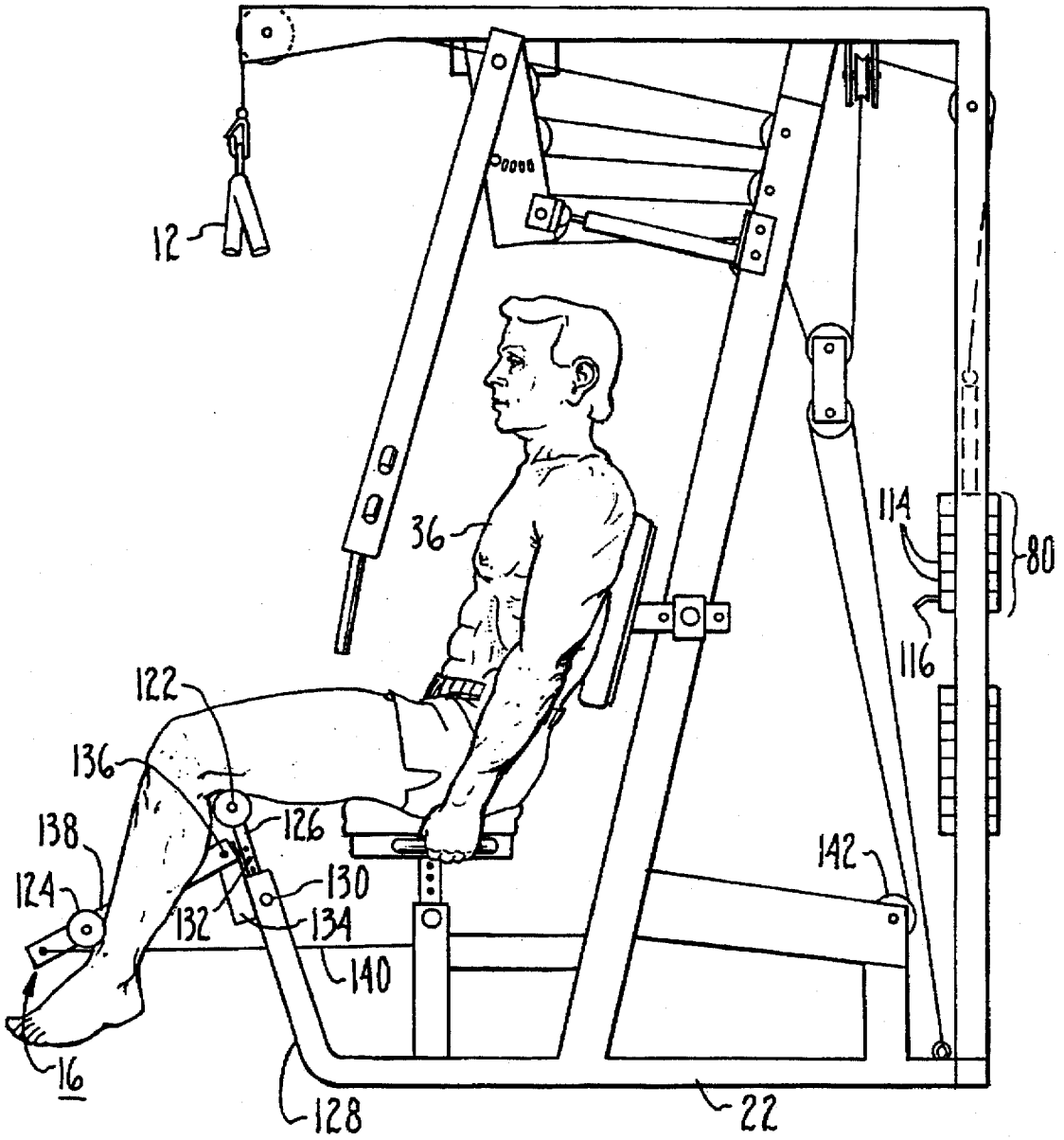
FIG. 3 is a side elevation view of the leg extension apparatus of the present invention, showing the pivot arm in the extended position.

Referring now to FIGS. 2B and 3, the details of the leg extension apparatus 16 are shown to include an upper padded roller 122 and a lower padded roller 124. The upper roller 122 is rotatably attached to an upper roller shaft 126, which in turn is slidably engaged with a hollow tube segment 128 formed in the bottom strut 22. A retention stud 130 can be inserted into the tube segment 128 and through one of a plurality of retention holes 132 formed in the upper roller shaft 126, to rigidly connect the upper shaft 126 to the tube segment 128.

Accordingly, it is to be understood that the elevation of the upper roller 122 with respect to the bottom strut 22 can be selectively established according to the desire of the person 36 by inserting the retention stud 130 into the appropriate retention hole 132. For example, the upper roller 122 can be positioned at a relatively high elevation, to permit the person 36 to anchor his legs beneath the roller 122 for performing lat pull-down exercises. On the other hand, the roller 122 can be positioned at a relatively low elevation to permit the person 36 to drape his knees over the roller 122 for performing leg extension exercises.

Still referring to FIGS. 2B and 3, a support flange 134 is shown connected to the tube segment 128, and a pivot pin 136 extends transversely through the support flange 134. A pivot arm 138 is rotatably engaged with the pivot pin 136, and thus is pivotably connected to the support flange 134. As shown, the lower roller 124 is rotatably mounted on pivot arm 138. In accordance with the present invention, the pivot arm 138 is movable between a rest position, shown in FIG. 2B, and an extended position, shown in FIG. 3.

To provide a means for transferring a force to the pivot arm 138 that will oppose motion of the pivot arm 138 toward the extended position shown in FIG. 3, a weight transfer cable 140 is attached to the pivot arm 138 and extends partially around the periphery of a fifth guide pulley 142. The weight transfer cable 140 extends around the second guide pulley 96 and is attached to the bottom strut 22, so that a force that opposes motion of the pivot arm 138 toward the extended position is transferred through the guide pulley block 98 and the weight transfer cable 140 to the pivot arm 138.

It is to be appreciated that machine 10 can be made of any suitable material well-known in the art. For example, lever arm 14 and frame 18 can be made of a strong material, such as steel or other composite material. Bricks 114 can be made of a suitable heavy material, e.g., iron, iron alloy, or encased sand. If desired, bricks 114 can be replaced with manually-loaded disc-shaped weights (not shown), familiarly referred to as weight plates. Furthermore, pulleys 64 and sheaves 68 can be suitable steel or hard plastic discs which are appropriately configured to guide a cable around their respective peripheries.

While a full and complete disclosure of a preferred embodiment of the present invention is set forth above, it is to be understood that various modifications, alternate constructions, and equivalent structures may be used without departing from the spirit of the present invention, and that the only limitations intended for the present invention are defined by the appended claims. For example, ROM block 28 can alternatively be attached to bottom strut 22 and the block-and-tackle system disclosed above configured as appropriate to transfer the weight of mass 80 to lever arm 14. Also, the distances a, b, and c can be established such that the magnitude of the force required to move lever arm 14 toward the extended position exceeds the magnitude of the weight of mass 80.

What is claimed:

1. An exercise apparatus, comprising:

a support frame;

resistance means on said support frame for providing resistance to exercises performed on said apparatus;

an adjustment member pivotally mounted on said frame for rotation about a pivot axis, the adjustment member having a series of spaced holes extending along an arc;

a lever arm pivotally mounted relative to said adjustment member and rotatable into any one of a series of selected orientations relative to said adjustment member;

a connecting pin for releasably connecting said lever arm to any selected one of said holes in said adjustment member to secure said lever arm at a selected orientation relative to said adjustment member whereby said lever arm and adjustment member are rotatable together about said pivot axis;

a cable and pulley linkage linking said resistance means to said lever arm, whereby a user can rotate said lever arm in a first direction from a rest position towards an extended position against the resistance of said resistance means;

said cable and pulley linkage including at least one pulley attached to said adjustment member, at least one pulley attached to said frame, and a cable extending at least partially around each of said pulleys; and said cable having a first end linked to said resistance means and a second end linked to an exercise device.

2. The apparatus as claimed in claim 1, wherein the adjustment member and lever arm are rotatable about the same pivot axis and said arc is centered on the pivot axis.

3. The apparatus as claimed in claim 1, including a pivot shaft secured to said frame, said adjustment member and said lever arm each being rotatably attached to said pivot shaft.

4. The apparatus as claimed in claim 1, wherein said cable and pulley linkage includes at least two pulleys secured in tandem to said adjustment member.

5. The apparatus as claimed in claim 1, wherein said resistance means comprises a weight stack and said cable and pulley linkage includes a cable having a first end secured to said weight stack, whereby rotation of said lever arm and adjustment member raises said weight stack.

6. The apparatus as claimed in claim 1, wherein said frame includes a base, an upright portion extending upwardly from said base, and a top strut secured to said upright portion, and said adjustment member is pivotally secured to said top strut.

7. The apparatus as claimed in claim 6, including a stop member having a first end secured to said upright portion of said frame and a second end facing said adjustment member and comprising a stop defining said rest position and comprising means for limiting motion of said adjustment member and lever arm beyond said rest position in a second direction opposite to said first direction.

8. The apparatus as claimed in claim 7, including a stop surface on said adjustment member for engaging the second end of said stop member in said rest position.

9. The apparatus as claimed in claim 1, wherein said lever arm comprises a chest press bar.

10. The apparatus as claimed in claim 1, wherein said frame has an upper portion and a lower, base portion, said upper portion includes a top strut and said adjustment member and lever arm are suspended from said top strut.

11. The apparatus as claimed in claim 10, wherein said lever arm includes a central portion pivotally linked to said frame, a pair of spaced gripping bars depending downwardly from said central portion, and a pair of gripping handles, each handle being secured to a respective one of said gripping bars.

12. The apparatus as claimed in claim 1, wherein said frame includes a strut, a pivot pin secured to said strut and extending transversely relative to said strut, said pin having first and second ends projecting in opposite directions from said strut, said lever arm having first and second parallel arm portions, said first arm portion having a first end pivotally secured to the first end of said pivot pin and said second arm portion having a second end pivotally secured to the second end of said pivot pin, and said adjustment member is pivotally secured to said pivot pin at a location between said first and second arm portions and is located between said first and second arm portions.

13. The apparatus as claimed in claim 1, wherein at least part of said adjustment member comprises a flat plate and said holes extend in an arc across said flat plate.

14. The apparatus as claimed in claim 1, including a seat assembly mounted on the frame for performing exercises in a seated position, the frame including an upwardly extending portion spaced forwardly from said seat assembly, a roller shaft adjustably mounted in said upwardly extending portion, the roller shaft having an upper end and a roller pad rotatably mounted on said upper end, and being movable relative to said upwardly extending portion of said frame between a series of extended positions in which said roller pad is at different heights relative to said seat assembly, and releasable locking means for releasably locking said shaft in any one of said extended positions, whereby said roller pad can be selectively positioned behind the knees of a seated user or above the user's legs in order to act as a leg anchor.

15. An exercise apparatus, comprising:

a support frame;

resistance means on said support frame for providing resistance to exercises performed on said apparatus;

an adjustment member pivotally mounted on said frame for rotation about a pivot axis, the adjustment member having a series of spaced holes extending along an arc;

a lever arm pivotally mounted relative to said adjustment member and rotatable into any one of a series of selected orientations relative to said adjustment member;

a connecting pin for releasably connecting said lever arm to any selected one of said holes in said adjustment member to secure said lever arm at a selected orientation relative to said adjustment member whereby said lever arm and adjustment member are rotatable together about said pivot axis;

a cable and pulley linkage linking said resistance means to said lever arm, whereby a user can rotate said lever arm in a first direction from a rest position towards an extended position against the resistance of said resistance means;

said cable and pulley linkage comprising first and second pulleys rotatably attached to said adjustment member, and third and fourth pulleys rotatably secured to said frame, and a cable having a first end linked to said resistance means and a cable portion extending successively partially around said third pulley on said frame, said first pulley on said adjustment member, said fourth pulley on said frame, and said second pulley on said adjustment member.

16. The apparatus as claimed in claim 15, wherein said cable has a second end and a pull down bar is secured at the second end of said cable.

17. An exercise apparatus, comprising:

a support frame;

resistance means on said support frame for providing resistance to exercises performed on said apparatus;

an adjustment member pivotally mounted on said frame for rotation about a pivot axis;

a lever arm pivotally mounted relative to said adjustment member and rotatable into any one of a series of selected orientations relative to said adjustment member;

an adjustment mechanism having a first part mounted on said adjustment member and a second part mounted on said lever arm;

one part of said adjustment mechanism comprising a plate having a series of spaced holes extending along an arc;

the other part comprising a connecting pin for releasable insertion in any selected one of said holes in said one part to secure said lever arm at a selected orientation relative to said adjustment member whereby said lever arm and adjustment member are rotatable together about said pivot axis;

a cable and pulley linkage linking said resistance means to said lever arm, whereby a user can rotate said lever arm in a first direction from a rest position towards an extended position against the resistance of said resistance means;

said cable and pulley linkage including at least one pulley attached to said adjustment member, at least one pulley attached to said frame, and a cable extending at least partially around each of said pulleys; and the cable having a first end linked to said resistance means and a second end extending beyond said pulleys for attachment to a further exercise device.

18. An exercise apparatus, comprising:

a support frame having an upper region and a lower region;

resistance means on said support frame for providing resistance to exercises performed on said apparatus;

a lever arm pivotally connected to the upper region of said support frame;

a cable and pulley linkage linking said lever arm to said resistance means and biasing said lever arm towards a rest position;

a stop member for limiting movement of said lever arm beyond said rest position;

an adjustment device for varying the spacing between said lever arm and said stop member in said rest position, said adjustment device comprising means for adjusting the orientation of said lever arm relative to said frame in said rest position;

the adjustment device having an extendible part for contacting said stop member in said rest position, and a releasable locking means for releasably securing said extendible part to said lever arm in a selected extended position;

said cable and pulley linkage including at least one pulley attached to said frame, at least one pulley attached to said adjustment device, and a cable extending at least partially around each of said pulleys; and the cable having a first end linked to said resistance means and a second end extending beyond said pulleys for attachment to a further exercise device.

19. An exercise apparatus, comprising:

a support frame;

a lever arm pivotally connected to said support frame;

a resistance means on said support frame for providing resistance to exercises performed on said apparatus;

cable and pulley means for linking said resistance means to said lever arm whereby pivotal movement of said lever arm relative to said frame in a first direction opposes said resistance means;

said resistance means biasing said lever arm towards a rest position in a second direction opposite to said first direction;

stop means for preventing movement of said lever arm in said second direction beyond a rest position; and adjustment means for adjusting the rest orientation of said lever arm relative to said frame in said rest position while permitting said lever arm to pivot in said first direction away from said rest position;

said cable and pulley means including at least two pulleys attached to said adjustment means, said pulleys defining a periphery, and at least two sheaves attached to said frame, said sheaves defining respective peripheries, a cable serially disposed partially around each of said peripheries forming a tackle, said cable having a first end and a second end; and said first cable end providing an attachment point for an exercise means and said resistance means being attached to the second cable end.

* * * * *